US008576066B2

(12) United States Patent
Bivens et al.

(10) Patent No.: US 8,576,066 B2
(45) Date of Patent: Nov. 5, 2013

(54) MANAGING EMERGENCY RESPONSE SERVICES USING MOBILE COMMUNICATION DEVICES

(75) Inventors: John Alan Bivens, Ossining, NY (US); Joel W. Branch, Hamden, CT (US); Rajarsh Idas, Armonk, NY (US); Robert G. Farrell, Cornwall, NY (US); Stacy F. Hobson, Poughkeepsie, NY (US); Daby M. Sow, Croton On Hudson, NY (US)

(73) Assignee: International Business Machines Corporation, Armonk, NY (US)

( * ) Notice: Subject to any disclaimer, the term of this patent is extended or adjusted under 35 U.S.C. 154(b) by 391 days.

(21) Appl. No.: 13/036,612

(22) Filed: Feb. 28, 2011

(65) Prior Publication Data

US 2012/0218102 A1 Aug. 30, 2012

(51) Int. Cl.
*G08B 1/08* (2006.01)

(52) U.S. Cl.
USPC ..... 340/539.13; 455/404.1; 455/404.2

(58) Field of Classification Search
USPC ..... 340/539.13, 539.12; 455/404.1, 404.2, 455/456.1, 521
See application file for complete search history.

(56) References Cited

U.S. PATENT DOCUMENTS

| | | | | |
|---|---|---|---|---|
| 4,228,419 | A | 10/1980 | Anderson | |
| 6,522,263 | B2 | 2/2003 | Jones | |
| 6,684,137 | B2 | 1/2004 | Takagi et al. | |
| 6,775,356 | B2 | 8/2004 | Salvucci et al. | |
| 7,046,140 | B2 | 5/2006 | Adamczyk et al. | |
| 8,190,118 | B2 * | 5/2012 | Sennett et al. | 455/404.1 |
| 2001/0051849 | A1 | 12/2001 | Boone | |
| 2002/0186147 | A1 | 12/2002 | Basinger | |
| 2005/0001720 | A1 | 1/2005 | Mason et al. | |
| 2005/0245232 | A1 | 11/2005 | Jakober et al. | |
| 2006/0095199 | A1 | 5/2006 | Lagassey | |
| 2007/0287409 | A1 | 12/2007 | Hwang | |
| 2008/0012762 | A1 | 1/2008 | James | |
| 2008/0252485 | A1 | 10/2008 | Lagassey | |
| 2009/0002145 | A1 | 1/2009 | Berry et al. | |
| 2009/0221263 | A1 | 9/2009 | Titus et al. | |
| 2009/0247189 | A1 | 10/2009 | Sennett et al. | |
| 2009/0284348 | A1 | 11/2009 | Pfeffer | |
| 2010/0048164 | A1 | 2/2010 | Boutihane | |
| 2010/0115609 | A1 | 5/2010 | Spence | |
| 2011/0130636 | A1 * | 6/2011 | Daniel et al. | 340/3.1 |
| 2012/0220259 | A1 * | 8/2012 | Sennett et al. | 455/404.2 |

* cited by examiner

*Primary Examiner* — John A Tweel, Jr.
(74) *Attorney, Agent, or Firm* — Jose Gutman; Fleit Gibbons Gutman Bongini & Bianco PL

(57) ABSTRACT

One or more embodiments manage emergency response services. An emergency event is determined to have occurred. A set of civilian responders currently available to respond to the emergency event is selected from a plurality of civilian responders in response to determining that the emergency event has occurred. Each civilian responder in the set of civilian responders is associated with at least one wireless communication device. The set of civilian responders is notified that the emergency event has occurred. A set of emergency event information associated with the emergency event is transmitted to at least one wireless communication device associated with each civilian responder in the set of civilian responders.

20 Claims, 15 Drawing Sheets

116

204

| User ID (202) | User Name (206) | Device Type (210) | Comm. Preferences (214, 216) | Contact Addresses (220) | Specialties (224) | Current Location (230) | Availability (234) | Other Data (240) | ... |
|---|---|---|---|---|---|---|---|---|---|
| USER_A | Bill Williams | Cellular phone | SMS and MMS | 555-123-4567 | N/A | N/A | Available | N/A | ... |
| USER_B | 208 Mike Smith | Smart phone 212 | Email, SMS, MMS, Video, Web, Application, Audio 218 | msmith@email.xyz 555-234-5678 222 | 226 Trauma surgeon 228 | X° Y' Z 232 | 236 N/A | Calendar information available at XXX.XXX.X.X 242 | ... |
| ... | ... | ... | ... | ... | ... | ... | ... | ... | ... |
| ... | ... | ... | ... | ... | ... | ... | ... | ... | ... |
| USER_N | Jane Johnson | Laptop | Video, Email, Web | jjohnson@email.xyz | Licensed in CPR and first aid | N/A | Not Available 238 | N/A | ... |

FIG. 2

1002

IF RESPONDER_B, WHO IS A DOCTOR, HAS NOT ARRIVED YET PERFORM THE FOLLOWING:

ATTEND TO VICTIM MICHELLE FIRST IF POSSIBLE

FOR VICTIM MICHELLE:
STABILIZE THE BROKEN ARM AS FOLLOWS:
USE A TOWEL, SHIRT, ETC. AS A SLING
(1) PLACE SLING UNDER HER ARM
(2) THEN PLACE SLING AROUND HER NECK
(3) TIE THE TWO ENDS OF SLING BEHIND HER NECK
(4) OPTIONALLY IMMOBILIZE ARM AGAINST BODY WITH ANOTHER SHIRT, TOWEL, ETC.

FOR VICTIM BOB:
STABILIZE THE NECK AS FOLLOWS:
PLACE PALMS ON EITHER SIDE OF HIS HEAD
WRAP FINGERS AROUND THE CHIN AND NECK
ADVISE HIM NOT TO MOVE
CONTINUE TO STABILIZE HIS NECK UNTIL RESPONDER_B OR AUTHORITIES ARRIVE
.....

132

106

FIG. 10

MANAGING EMERGENCY RESPONSE SERVICES USING MOBILE COMMUNICATION DEVICES

BACKGROUND

The present invention generally relates to emergency response systems, and more particularly relates to managing emergency response services.

Around the globe, vehicle traffic congestion is growing at an astounding rate, and will likely continue to increase as more people continue to move into urban settings. Given this trend, even if the amount of traffic accidents remains consistent, emergency response authorities (e.g., police, firefighters, and emergency medical technicians (EMTs)) will have a more difficult time responding to accidents due to longer average travel times to accident sites. Overall, these trends can place accident victims in further peril, especially if they have been involved in a rather severe accident and/or require immediate (and specialized) medical attention due to special medical conditions.

BRIEF SUMMARY

In one embodiment, a method for managing emergency response services is disclosed. The method comprises determining that an emergency event has occurred. A set of civilian responders currently available to respond to the emergency event is selected from a plurality of civilian responders in response to determining that the emergency event has occurred. Each civilian responder in the set of civilian responders is associated with at least one wireless communication device. The set of civilian responders is notified that the emergency event has occurred. A set of emergency event information associated with the emergency event is transmitted to at least one wireless communication device associated with each civilian responder in the set of civilian responders.

In another embodiment, a system for managing emergency response services is disclosed. The system comprises a memory and a processor that is communicatively coupled to the memory. An emergency response manager is communicatively coupled to the memory and the processor. The emergency response manager is configured for performing a method. The method comprises determining that an emergency event has occurred. A set of civilian responders currently available to respond to the emergency event is selected from a plurality of civilian responders in response to determining that the emergency event has occurred. Each civilian responder in the set of civilian responders is associated with at least one wireless communication device. The set of civilian responders is notified that the emergency event has occurred. A set of emergency event information associated with the emergency event is transmitted to at least one wireless communication device associated with each civilian responder in the set of civilian responders.

In yet another embodiment, a computer program product for managing emergency response services is disclosed. The computer program product comprises a storage medium readable by a processing circuit and storing instructions for execution by the processing circuit for performing a method. The method comprises determining that an emergency event has occurred. A set of civilian responders currently available to respond to the emergency event is selected from a plurality of civilian responders in response to determining that the emergency event has occurred. Each civilian responder in the set of civilian responders is associated with at least one wireless communication device. The set of civilian responders is notified that the emergency event is transmitted to at least one wireless communication device associated with each civilian responder in the set of civilian responders.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention, in which:

FIG. 2 shows one example of a plurality of user profiles according to one embodiment of the present invention;

FIGS. 3-11 shows various examples of a user interface associated with a civilian responder wireless device displaying information received from an emergency response system according to one embodiment of the present invention;

DETAILED DESCRIPTION

Operating Environment

Figure 1:
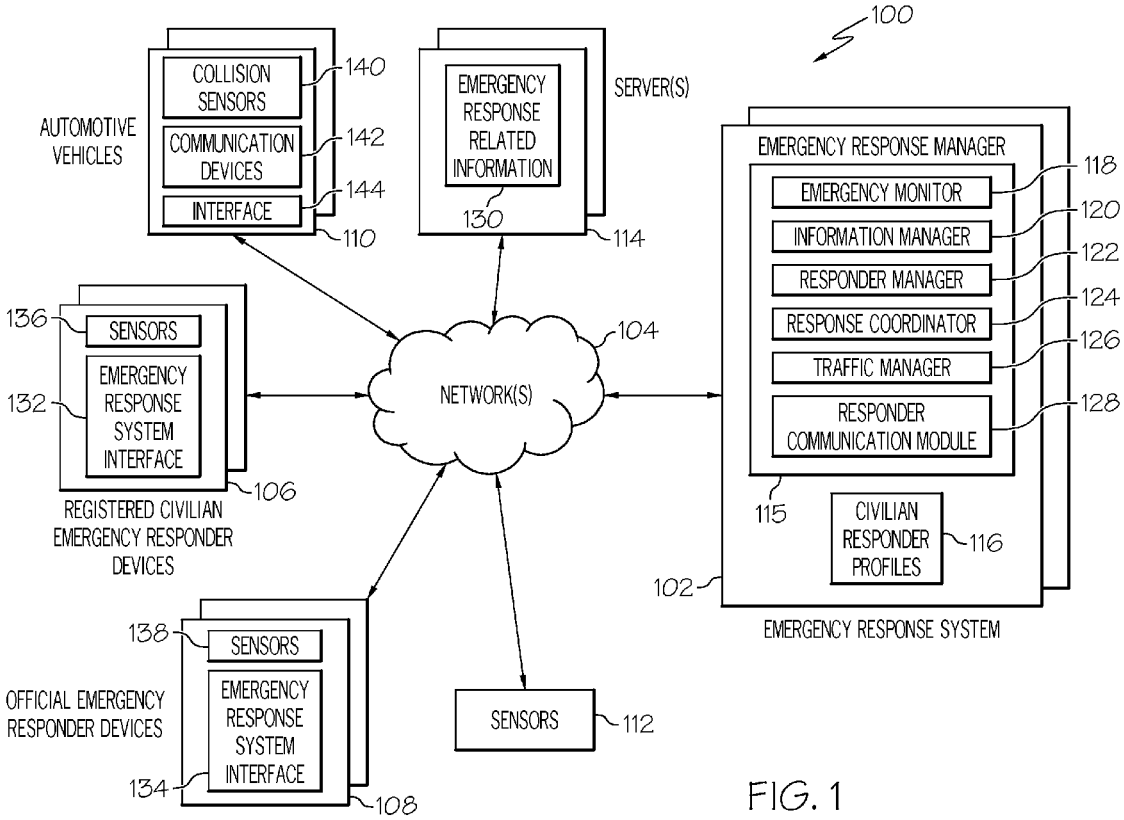
FIG. 1 is a block diagram illustrating one example of an operating environment comprising an adaptive search personalization system according to one embodiment of the present invention.

FIG. 1 shows one example of an operating environment 100 applicable to various embodiments of the present invention. The operating environment 100, in one embodiment, comprises an emergency response system (ERS) 102 communicatively coupled to one or more networks 104. It should be noted that the emergency response system 102 can be comprised of a single information processing system or distributed across a plurality of information processing systems. The emergency response system 102 can also reside within a cloud computing environment, a more conventional networking environment, or a combination of both.

The network(s) 104, in one embodiment, comprises one or more of a local area network, wide area network, the World Wide Web, wireless networks, wireless communication networks, public switched telephone networks, and/or the like. With respect to a wireless communication network, this type of network can comprise a mobile phone network, a mobile text messaging device network, a pager network, or the like. Further, the communications standard of a wireless communication network can be Code Division Multiple Access (CDMA); Time Division Multiple Access (TDMA), Global System for Mobile Communications (GSM), General Packet Radio Service (GPRS), an Evolution Data Only (EV-DO), Universal Mobile Telecommunications System (UMTS), an Integrated Dispatch-Enhanced Network (iDEN), Frequency Division Multiple Access (FDMA), other IEEE 802.16 standards, Orthogonal Frequency Division Multiplexing (OFDM), Orthogonal Frequency Division Multiple Access (OFDMA), LTE, UMB, WiMax, or other technologies. Additionally, the wireless communications network can also comprise text messaging standards, for example, Short Message Service (SMS), Enhanced Messaging Service (EMS), Multimedia Messaging Service (MMS), or the like.

FIG. 1 also shows various entities communicatively coupled to the network(s) 104 as well. For example, FIG. 1 shows that registered civilian emergency responder devices 106, official emergency responder devices 108, automotive vehicles 110, sensors 112, and one or more servers 114 are communicatively coupled to the network(s) 104. The registered civilian emergency responder devices 106 are devices such as, but not limited to, a two-way radio, a cellular telephone, a mobile phone, a smartphone, a two-way pager, a wireless messaging device, a laptop/computer, a personal digital assistant, and other similar devices able to receive wireless data. The official emergency responder devices 108 can also comprise these types of devices and can also be an emergency response vehicle such as an ambulance, helicopter, or the like. Registered civilian emergency responder devices 106 are associated with individuals that have registered with the ERS 102 to help respond to an emergency situation such as an accident, fire, natural disaster, or any other situation that requires emergency response services. The official emergency responder devices 108 are associated with individuals who are official emergency responders such as EMTs, police, firefighters, or other similar individuals.

The automotive vehicles 110 can be any vehicle such as, but not limited to, a car, a truck, a motorcycle, a train, a boat, airplane, helicopter, or the like. The sensors 112 can include, but are not limited to, traffic sensors, video cameras, still photo cameras, motion sensors, audio devices, or the like. These sensors 112 can be located anywhere within, near, or related to an emergency. For example, if there is an accident on a road the sensors 112 can comprise traffic sensors around the accident area or along the route that an official emergency responder needs to traverse; video cameras on traffic lights around the accident area or along this route; message display units around the accident area or along this route; and/or the like.

These sensors 112 are able to transmit their data back to the ERS 102 through the network 104. Alternatively, one or more of the sensors 112 can transmit their data to one or more servers 114. The ERS 102 is then able to retrieve this data, referred to as emergency response related information 130, from this server(s) 114. The emergency response related information 130, as will be discussed in greater detail below, is any type of information such as sensors data, medical information of an individual associated with an emergency situation, traffic data, location information of official emergency responders, information associated with registered civilian emergency responders, or the like that ERS 102 utilizes to manage emergency response services.

In one embodiment, the ERS 102 comprises an emergency response manager (ERM) 115 and civilian responder profiles 116. The civilian responder profiles 116 comprise information associated with civilians (i.e., non-official emergency responders) and their devices 106 and sensors 136, 138 that have registered with the ERS 102 to provide assistance during an emergency situation. It should be noted that the civilian responder profiles 116 can reside outside of the ERS 102 as well. The civilian responder profiles 116 are discussed in greater detail below.

The ERM 115 comprises an emergency monitor 118, an information manager 120, a responder manager 122, a response coordinator 124, a traffic manager 126, and a responder communication module 128. It should be noted that one or more of these components 118 to 128 can reside outside of the ERM 115 and/or the ERS 102 as well. Each of these components 118 to 128 of the ERM 115 are discussed in greater detail below.

The ERS 102, in one embodiment, communicates with one or more of these entities 106, 108, 110, 112, 114 to manage emergency response services. For example, each of the registered civilian emergency responder devices 106 and the official emergency responder devices 108 comprise an ERS interface 132, 134 that allows the devices 106 to send and receive information to/from the ERS 102. This interface 132 can be an application running on the device 106, a web browser, or the like. Also, the interface 132 can simply be the display, keyboard, and/or audio devices of the device 106. In other words, a dedicated ERS application is not required to communicate with the ERS 102. For example, information can be sent/received to/from the ERS 102 via SMS, MMS, email, push notifications, a phone call, or the like. It should be noted that each of these devices 106, 108 can send information related to an emergency situation directly to the ERS 102 through the network(s) 104. Alternatively, these devices 106, 108 can send the information to the server(s) 114 where it is stored as emergency response related information 130.

The responder devices 106, 108 can also comprise one or more sensors 136, 138. These sensors 136, 138 can include, but are not limited to, still/video cameras, microphones, biometric sensors, vital sign sensors, and/or the like. The responder devices 106, 108 are able to transmit this information via the interface 132, 134 to the ERS 102 and/or the one or more servers 114. If this information is transmitted to the server(s) 114 it is stored, in one embodiment, as emergency response related information 130.

The ERS 102 is also able to communicate with one or more vehicles 110. For example, each vehicle 110 comprises collision sensors 140 and/or one or more communication devices 142. The collision sensors 140 detect when the vehicle 110 has been in a collision and can transmit this information to the ERS 102 (or other emergency authority in communication with the ERS 102) so that it can automatically create an emergency response strategy and dispatch the appropriate responders. It should be noted that the vehicle 110 can comprise other sensors such as an "emergency button" that the user can press to send out an emergency signal to the ERS 102 or other emergency authority in communication with the ERS 102.

The vehicle 110 can also be associated with a registered civilian emergency responder. In this example, the vehicle comprises one or more communication devices 142 that allow the user to transmit data from the vehicle 110 to the ERS 102 through the network 104. It should be noted that these devices 142 can also automatically send data from the vehicle 110 to the ERS 102 based on information collected by the sensors 140. These one or more communication devices 142 also allow the user to receive data from the ERS 102 via an interface 144 in the vehicle 110. The interface 144 can be a radio, in-vehicle wireless communications system, Global Positioning Satellite system, or the like.

Managing Emergency Response Services

As discussed above, the ERM 115 detects emergency situations and automatically or at least semi-automatically coordinates and facilitates emergency response services for the emergency situation. For example, the ERM 115 provides prompt emergency response services such as, but not limited to, first aid to individuals involved in an emergency by jointly facilitating the activities of emergency response authorities and nearby civilians using a combination of sensors, actuators, and wireless communication devices.

The ERM 115 utilizes the various sensors 112, 136, 138, 140 embedded in a vehicle 110, nearby environment (e.g., traffic cameras), or personal devices 106, 108 to detect emergency situations such as, but not limited to, vehicle collisions. The information gathered from the sensors 112, 136, 138, 140 is used by the ERM 115 to generate a description of the emergency situation (e.g., condition of the crash site and the vehicles' occupants). Other emergency response related information 130 such as historical (e.g., medical records) and real-time information (e.g., from biomedical sensors) is collected and optionally filtered by the ERM 115 to help assess a victim's medical condition. The ERM 115 uses information associated with the emergency (and its environment) and medical information associated with the victim(s) to provide the victim with the best possible response in the shortest amount of time given (1) the nature of the emergency including the victim's condition, (2) the ability (and willingness) of people nearby the emergency site to assist in an emergency response when notified on their device 106, 108 and (3) the emergency response authorities' estimated time of arrival to the emergency site.

Various embodiments of the present invention are advantageous over conventional emergency response systems because these conventional systems generally do not utilize information from civilians nor manage civilian involvement in responding to an emergency. Effectively including civilian involvement in such situations yields significant improvements in emergency response scenarios.

Also, the number of drivers (and people in general) carrying wireless communication devices is rapidly increasing. Therefore, civilians comprise valuable assets for helping respond to emergency situations. For example, photos/video taken by civilians at an emergency site can be sent by the ERM 115 to official emergency responders. The official emergency responders can use this information to best prepare for their response before arriving onsite. Such data (in addition to in-vehicle and environmental sensor data along with medical information regarding the victims involved in the emergency) can also be used by ERM 115 to determine if civilian involvement is required before official emergency responders arrive at the site.

Wireless communication devices or devices communicatively coupled to these types of devices can also be used to assist people in helping with an emergency before authorities arrive. For example, the ERM 115 can query a select group of nearby people who may be qualified or willing (depending on the severity of the accident) to assist in treating certain critical conditions of the accident victims, directing traffic, and other related tasks. Furthermore, the ERM 115 can assist such a group of people in responding via on-screen instructions on how to best treat a victim giving details collected by the system (via sensors and user feedback). For hands-free operation, the instructions may be over an audio channel.

Another advantage is that a delay in calls to emergency service centers as a 9-1-1 are not as detrimental since the ERM 115 can dispatch civilian responders to provide services prior to official emergency personnel arriving. The ERM 115 can also provide audiovisual assistance and provide a consistent flow of information between the accident site and emergency response authorities.

The following is a more detailed discussion on the ERM 115 and managing emergency response services based on civilian involvement and feedback. As discussed above, the ERM 115 maintains a set of civilian responder profiles 116. These profiles 116 are generated when a civilian registers with the ERM 115 indicating a desire to help in emergency situations when possible. The ERM 115 uses these profiles to, among other things, identify registered civilians to dispatch to an emergency situation. However, it should be noted that users are not required to register with the ERM 115 or have a profile 116 in order to interact with the ERM 115. FIG. 2 shows one example of a plurality of user profiles 116 maintained by the ERM 115. It should be noted that in FIG. 2 each row is considered a profile. However, other formats for storing a profile can also be used.

In particular, FIG. 2 shows a profile 116 that includes a plurality of columns. A first column 202, labeled "User_ID" includes entries 204 that uniquely identify each registered civilian responder. A second column 206, labeled "User Name" includes entries that identify the name of a registered civilian responder. For example, an entry 208 under this column 206 identifies that the name of the user with a User ID of Responder_A is "Bill Williams". A third column 210, labeled "Device Type", includes entries that indicate the types of devices that the user has registered with the ERM 115 to receive information from the ERM 115. For example, an entry 212 under this column 210 indicates that Responder_B is associated with a smart phone. The ERM 115 can use this information to determine the type of data and the format in which this data needs to packaged in when sending the data to the registered civilian responder.

A fourth column 214, labeled "Comm. Preferences" includes entries that identify how the registered civilian responder wants to be contacted by the ERM 115. For example, an entry 216 associated with RESPONDER_A indicates that this user wants to be contacted by SMS and/or MMS. However, an entry 218 associated with RESPONDER_B indicates that this user wants to be contacted by email, SMS, MMS, video, by web prompts, via an application, or by audio. The application can be an application residing on the user's device that is associated with the ERM 115 and displays information received from the ERM 115 or sends information from the device to the ERM 115. Also, the information in the "Comm. Preferences" column 214 can also include audio vs. text preferences. However, a default value can be to transmit both data types. A fifth column 220, labeled "Contact Addresses", includes entries that identify the addresses such as phone numbers, email addresses, social networking IDs, or the like that the ERM 115 is to use when communicating with a user. For example, an entry 222 associated with RESPONDER_B shows that the ERM 115 is to use an email address of "msmith@email.xyz" and/or a phone number of 555-234-5678 when communicating with the device of RESPONDER_B.

A sixth column 224, labeled "Specialties" includes entries that identify any special attributes of a registered civilian responder that can be used when responding to an emergency situation. For example, an entry 226 associated with RESPONDER_A indicates that the user is a standard civilian and does not comprise any special training. However, an entry 228 associated with RESPONDER_B indicates that this registered civilian responder is a trauma surgeon. The ERM 115 can use this information when determining which registered civilian responders to notify about an emergency situation and the response instructions to send these responders. For example, if an emergency situation is critical, the ERM 115 can select civilian responders with more specialized training such as RESPONDER_B and RESPONDER_N to respond to the situation as compared to selecting users such as RESPONDER_A that have lesser or no specialized training. Additionally, because the ERM 115 knows that RESPONDER_A is a normal civilian responder, RESPONDER_B is a trauma surgeon, and RESPONDER_N is licensed in CPR and first aid, the ERM 115 can send specialized emergency response instructions to each of these users. For example, the ERM 115 can instruct RESPONDER_A to help with traffic management, instruct RESPONDER_N to apply first aid until RESPONDER_B arrives, and instruct RESPONDER_B to stabilize the victim until the authorities arrive.

A seventh column 230, labeled "Current Location", includes entries that indicate a current location of a registered civilian responder. For example, an entry 232 associated with RESPONDER_B indicates that RESPONDER_B is currently located at X° Y' Z". In one embodiment, a registered civilian responder via an application associated with the ERM 115 on his/her device, selects an option that sends location information such as, but not limited to, GPS information to the ERM 115. The ERM 115 receives this information and updates the profile associated with this user accordingly. Alternatively, the ERM 115 communicates with wireless communication carrier service to obtain emergency GPS information for a device. It should be noted that other methods of obtaining a devices current location can also be used. The ERM 115 can use this information to identify registered civilian responders that are near a detected emergency site.

An eighth column 234, labeled "Availability", includes entries indicating whether a registered civilian responder is available to respond to an emergency. For example, an entry 236 associated with RESPONDER_A indicates that RESPONDER_A is available to respond. However, an entry 238 associated with RESPONDER_N indicates that RESPONDER_N is not available to respond. In one embodiment, a registered civilian responder via an application associated with the ERM 115 on his/her device, selects an option that informs the ERM 115 that the user is/not available/willing to respond to an emergency. The ERM 115 uses this information when selecting registered civilian responders to notify and dispatch to an emergency.

A ninth column 240, labeled "Other Data", includes entries comprising various other types of information. For example, one entry 242 comprises information associated with a calendar of a registered civilian responder. This calendar information can be the actual calendar information, link or address where the information can be obtained, or the like. The ERM 115 uses this calendar information when selecting registered civilian responders to notify and dispatch to an emergency. For example, based on calendar information the ERM 115 can determine if a registered civilian responder is currently available or might be needed at a more important event. For example, if an emergency is an accident with no injuries the ERM 115 can look at the calendar information for RESPONDER_N and determine that this user has to teach a first aid class in 1 hour. Therefore, the ERM 115 determines that RESPONDER_N has a more important engagement and that other registered civilian responders can be dispatched to the accident instead of RESPONDER_N. It should be noted that other information can be included under the "Other Data" column 240. Also, one or more columns can be deleted and/or added to the profile 116 as well.

It should be noted that, in one embodiment, the level of access of dynamic (and static) resource attributes (e.g., the information within the profiles 116) of a responder given to the ERM 115 is dependent on the situational awareness of the ERM 115. For example, one or more policies can be implemented within the ERM 115 that indicates when a civilian responder (e.g., a physician) is within close proximity to an accident, he/she allows more information about his/herself to be accessed by the ERM 115. In another example, the level of access can be dependent on the severity of the accident. For example, if a civilian responder is within a certain radius of a severe (i.e., life-threatening) accident, the ERM 115 can access the responder's electronic personal calendar information at a "finer" resolution. That is, the ERM 115 can analyze the content of calendar entries as opposed to querying only availability. For instance, the ERM 115 queries the civilian responder if a conflicting calendar appointment is for a party-party at work, as opposed to a critical surgery appointment. Various management and classification rules and artificial intelligence techniques can be are employed by the ERM 115 to differentiate between "critical" and "casual" calendar appointments.

Once a user has registered with the ERM 115, the ERM 115 is able to utilize these users in an emergency situation. The ERM 115, via the emergency monitor 118, detects and identifies emergency situations. For example, the ERM 115 can be communicatively coupled to an emergency system such as a 9-1-1 system that notifies the ERM 115 of an emergency. In another embodiment, the collision and emergency sensors 140 of a vehicle can report an emergency to the ERM 115. Additionally, the ERM 115 can monitor environmental sensors 112 such as, but not limited to, traffic cameras to detect an emergency situation. In yet another embodiment, a registered civilian emergency responder may have already been near an emergency site and notified the ERM 115 via his/her device 106.

Once the ERM 115 has detected an emergency situation the ERM 115, via the information manager 120, gathers information associated with the emergency. This information can include information that describes the emergency situation. For example, if the emergency situation is a vehicle accident, the ERM 115 can obtain collision information from the sensors 140 in the vehicle to assess the severity of the accident, where the vehicle experienced damage, and the like.

Also, the ERM 115 can perform sensor data analysis to "recreate" the conditions of the emergency, e.g., determine which driver most likely caused the accident by analyzing car system failures, sensor data from all cars involved in the collision, or even external road conditions. This can be used for treatment purposes (e.g., caution pedestrian helpers of icy conditions during assistance or guide pedestrians how to manipulate bodies) and/or prosecution purposes. In this "collision recreation" embodiment, a data buffering mechanism can be implemented within the ERM 115 to help store and analyze only sensor data having a high probability of being related to an emergency without negatively affecting memory resources.

The ERM 115 can also analyze environmental sensor information such as video or photographs to determine, for example, further hazardous conditions resulting from the accident (e.g., impending explosions, release of hazardous materials, damage to surrounding structures, etc.). Also, the ERM 115 can identify the passengers of the vehicle 110 either by registration records of the emergency system associated with the collision sensors 140 or from the emergency system itself, from a registered civilian emergency responder already near the accident, or the like. The ERM 115 can then obtain the medical history (shown as emergency response related information 130 in FIG. 1) of the victims if available. If a registered civilian emergency responder is already at the scene, this responder via his/her device 106 can send current medical conditions of the victims to the ERM 115 as determined by the responder or via biomedical sensor 136 coupled to the device 106.

The ERM 115 can utilize machine-based analysis techniques on the data gathered above to create a description of the emergency and to determine properties/attributes of the emergency. For example, the ERM 115 can determine that a car accident has occurred between two cars. The ERM 115, via the information manager 120, analyzes this information to perform one or more various actions. For example, the ERM 115 is able to determine the type of emergency, the severity of the emergency, the medical condition of the victims, traffic conditions around the emergency area, and other related information based on the information gathered. The ERM 115 can use this information in conjunction with the information in a responder profile to select civilians to respond to the emergency.

For example, the ERM 115, via the responder manager 122, analyzes the registered civilian responder profiles 116 to identify a set of civilian responders that are best suited to respond to this emergency or if any are needed at all in view of the information associated with the emergency that has been gathered. For example, the ERM 115 can determine the current location of civilian responders based on the location information within the profiles 116; from location information being transmitted directly to the ERM 115 from the devices 106; or from location information being transmitted to a wireless communication carrier of the device 106. Also, registered civilian responders can notify the ERM 115 that they are near the emergency site.

Figure 3:
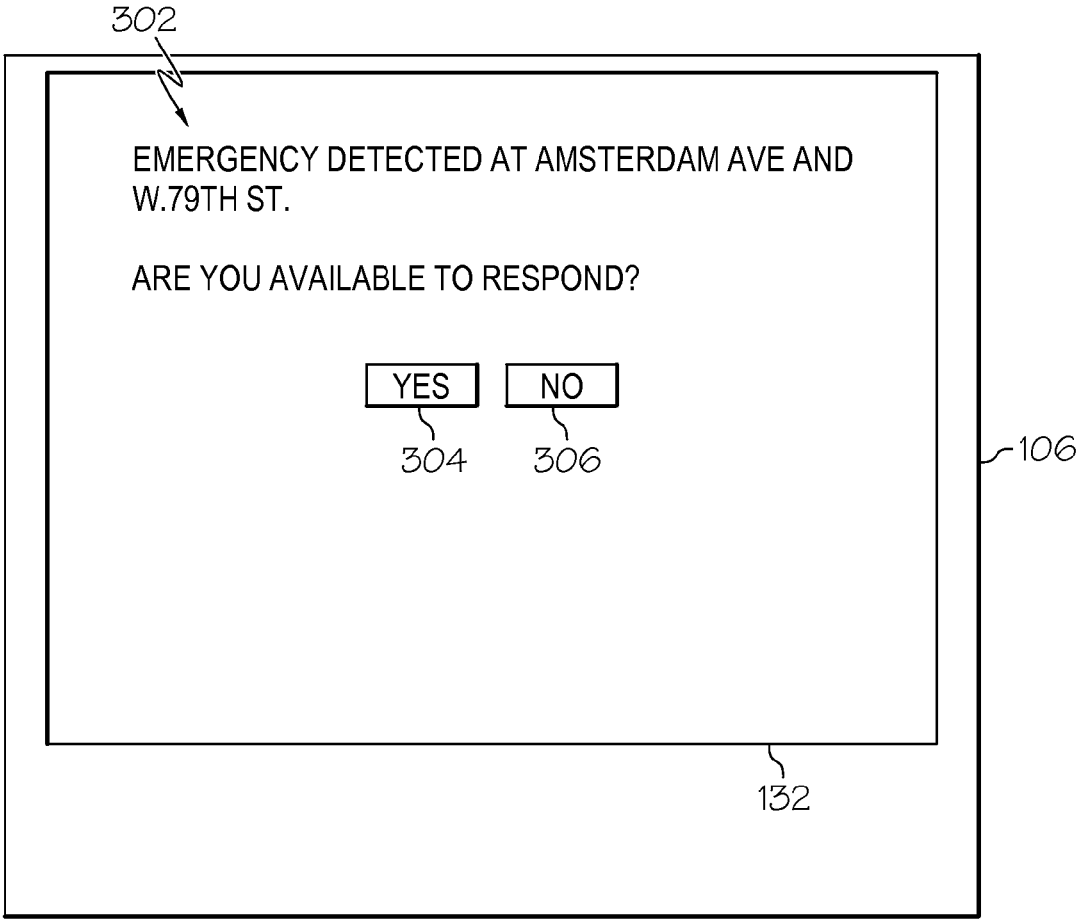

The ERM 115 also analyzes the profiles 116 to identify civilian responders that have indicated that they are able/willing to respond to an emergency. Alternatively the ERM 115 can query a registered device 106 to determine if the user is able/willing to respond. For example, FIG. 3 shows one example of this querying. In particular, FIG. 3 shows that the ERM 115 has sent a message 302 to a registered civilian using the contact preferences and contact address(es) of the civilian as indicated in the civilian's profile 116. This message 302 notifies the civilian responder of the location of the emergency, which is at the intersection of Amsterdam Ave. and W. 79$^{th}$ St in this example, and also asks if the user available to respond. The user is then able to respond to this query by sending an email, a reply SMS, and/or entering information into an application such as by selecting a "Yes" or "No" widget 304, 306 as shown in the example of FIG. 3. However, it should be noted that the user can respond by other mechanisms such as, but not limited to, SMS messages, MMS messages, email messages, or the like.

The ERM 115, via the responder manager 122, is then able to determine whether this registered civilian responder should be considered for selection. It should be noted that this querying can occur after a user has been selected by the ERM 115 as well. Information such as calendar information can also be used to determine if a responder should be selected, as discussed above. The ERM 115 can further analyze the profiles to identify the "specialties" and skills of registered civilian responders to determine whether a given responder should be selected over another responder.

In addition to monitoring information associated with civilian responders, the ERM 115 can also monitor information associated with official emergency responders. For example, the ERM 115 can receive information from official responders or from systems coupled to the official responders to determine an estimated time of arrival of the official responders at the emergency site. If the ERM 115 determines that the official responders will not be at the site before a given threshold of time occurs of if the ETA is increasing, the ERM 115 can expand the search "radius" for qualified civilian responders. In one embodiment, the ERM 115 is able to identify which official responders will respond to the emergency based on the emergency description and properties/attributes that have been collected, as discussed above. The ERM 115 can then analyze traffic activity between the emergency site and deployment points of emergency response authorities to determine the ETA to the site.

Based on the above, the ERM 115 then selects a set of civilian responders to respond to the emergency situation. Also, based on the previously collected information associated with the emergency, the ERM 115 can determine which type of official emergency responders are required. For example, based on this gathered information the ERM 115 can determine that the emergency was an accident with minor damage and not injuries. Therefore, the ERM 115 can pass this information to the appropriate authorities with a recommendation to only send police units and not medical responders.

The ERM 115, via the responder communication module 128, then notifies each of these selected civilian responders of the emergency and provides, via the response coordinator 124, pertinent information to these responders regarding the emergency. For example, using the communication preferences and contact addresses within each of the responders' profiles 116 the ERM 115, via the response coordinator, determines a set of location information associated with the emergency, current conditions of the emergency and victims based on the previous information that was gathered, instructions on how to respond, or the like to send to the device 106 associated with the responder. The ERM 115, via the responder communication module 128, then sends this information to the device 106 (or device 108) associated with the responder(s). It should be noted that in some embodiments the responders do not all receive the same information. For example, a responder that is determined to be a doctor or EMT can be sent the medical history of the victims as compared to sending this information to an unspecialized civilian responder. In other words, the ERM 115 can customize information, which can be audio, text, or other media, sent based on civilian responder attributes.

Also, the ERM 115 can monitor the quality of the communication link between itself and the devices 106, 108 to ensure that information is received by the devices 106, 108. For example, consider a responder that is receiving images/video on a smartphone over a wireless link to convey response instructions and the network bandwidth drops significantly. The ERM 115 can detect this bandwidth decrease and send lower quality imagery, change the modality used to transmit the instruction, or the like. For example, audio or text messaging can be used as opposed to video.

As noted above, the information sent to the civilian responders is sent from the ERM 115, via the responder communication module 128, to the devices 106 of the responders. FIGS. 4-10 illustrate various examples of sending and receiving information from the civilian responders. In one embodiment, the ERM 115 can send location information and/or directions to the responder to help the responder arrive at the emergency site.

Figure 4:
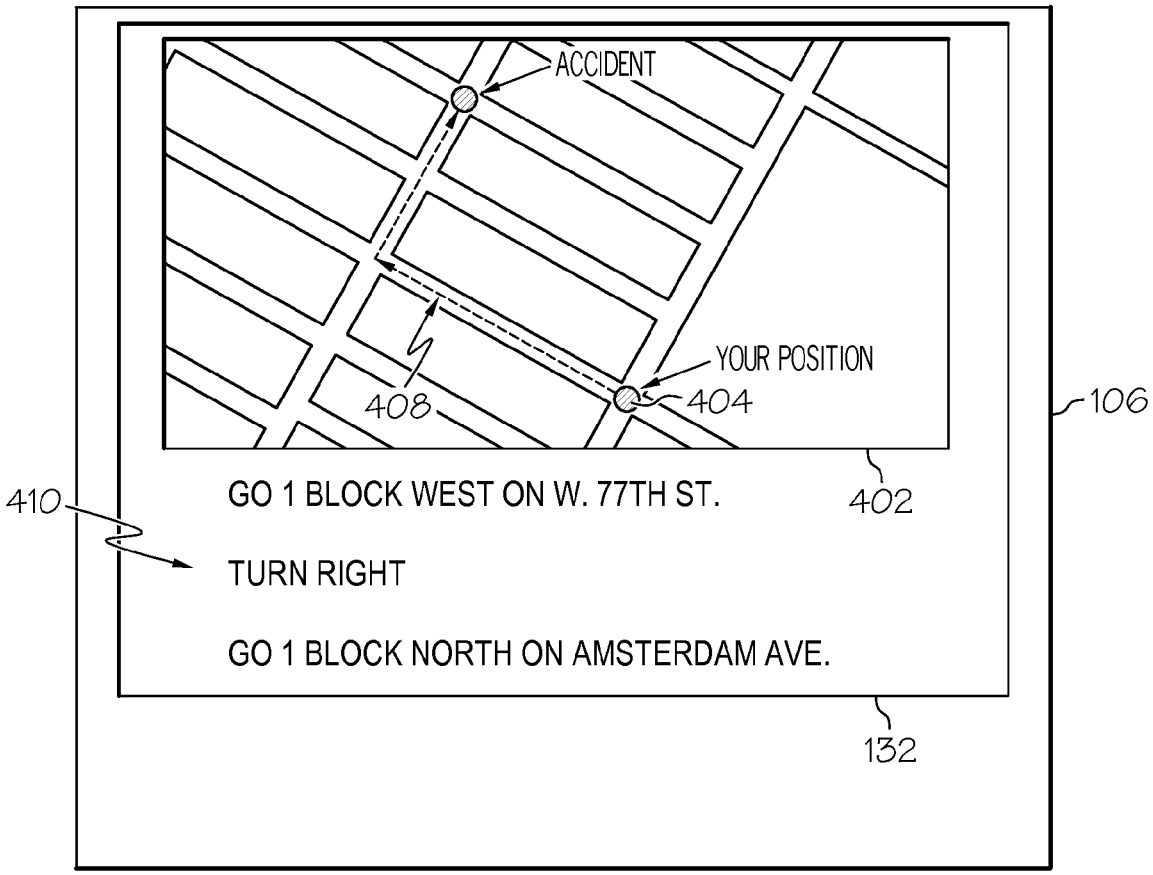

For example, FIG. 4 shows that the ERM 115 has sent a map 402 to the civilian responder device 106 that is being displayed to the user via the ERS interface 132 at the device 106. The map 402 is displaying the responder's current position 404 and the emergency site location 406. In addition, the map 402 displays a route 408 directly on the map that the responder is advised to take for arriving at the emergency site. The ERM 115 has also sent the directions in a text format 410 as well. It should be noted that that other location information can be displayed on the map 402 and/or interface 132 as well. For example, the locations of other responders can be displayed in real-time or almost real-time. A user is able to select a displayed responder and be shown information associated with that responder such as estimated time of arrival, responder attributes such as skills or specialties, and the like.

Figure 5:
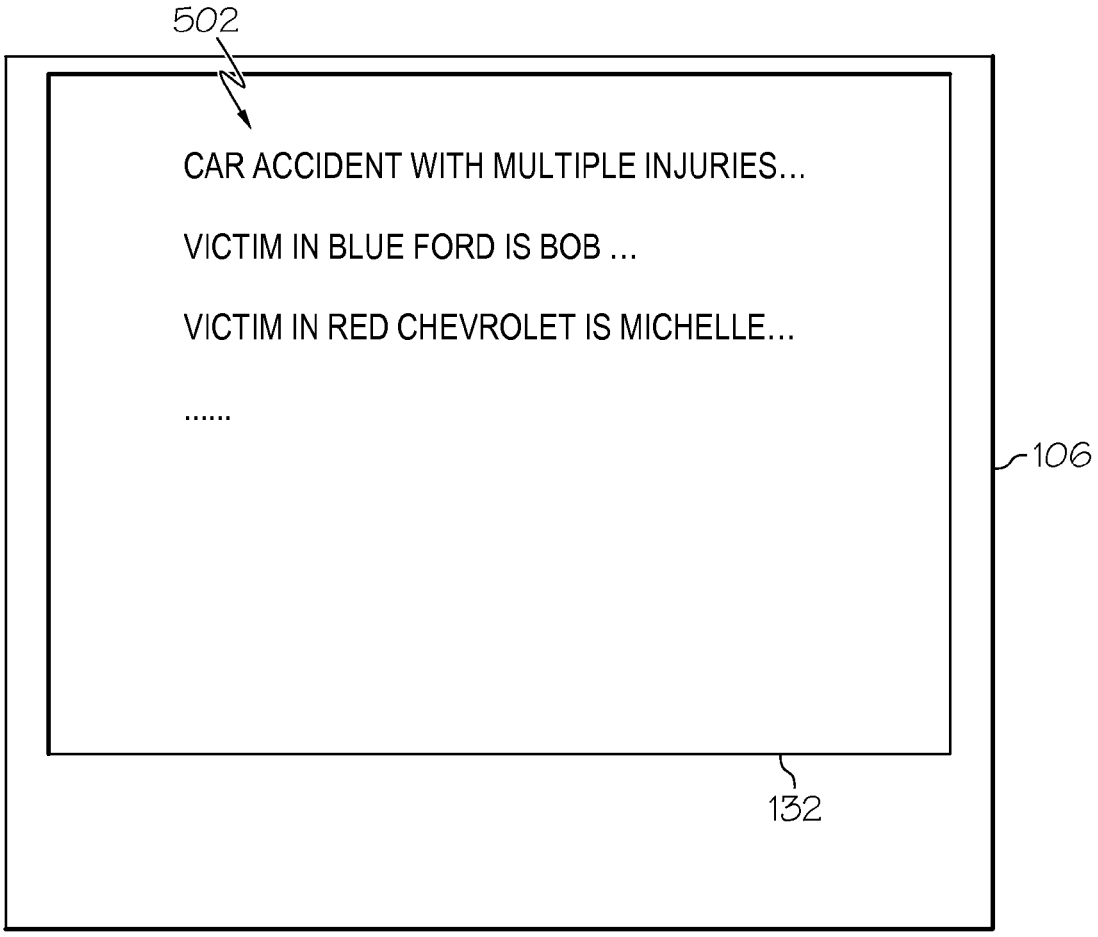

The ERM 115 also sends a description of the emergency to each of the responders as well. As discussed above, this description is generated by the ERM 115 from sensors 140 within the vehicles involved in the accident, environmental sensors 112, responders already at the emergency, and/or the like. For example, FIG. 5 shows one example of a description 502 being displayed to a responder via the ERS interface 132 via the responder's device 106. In this example, the description 502 describes the type of emergency, e.g., a car accident, and also identifies the victims involved in the accident e.g., Bob and Michelle.

Figure 6:
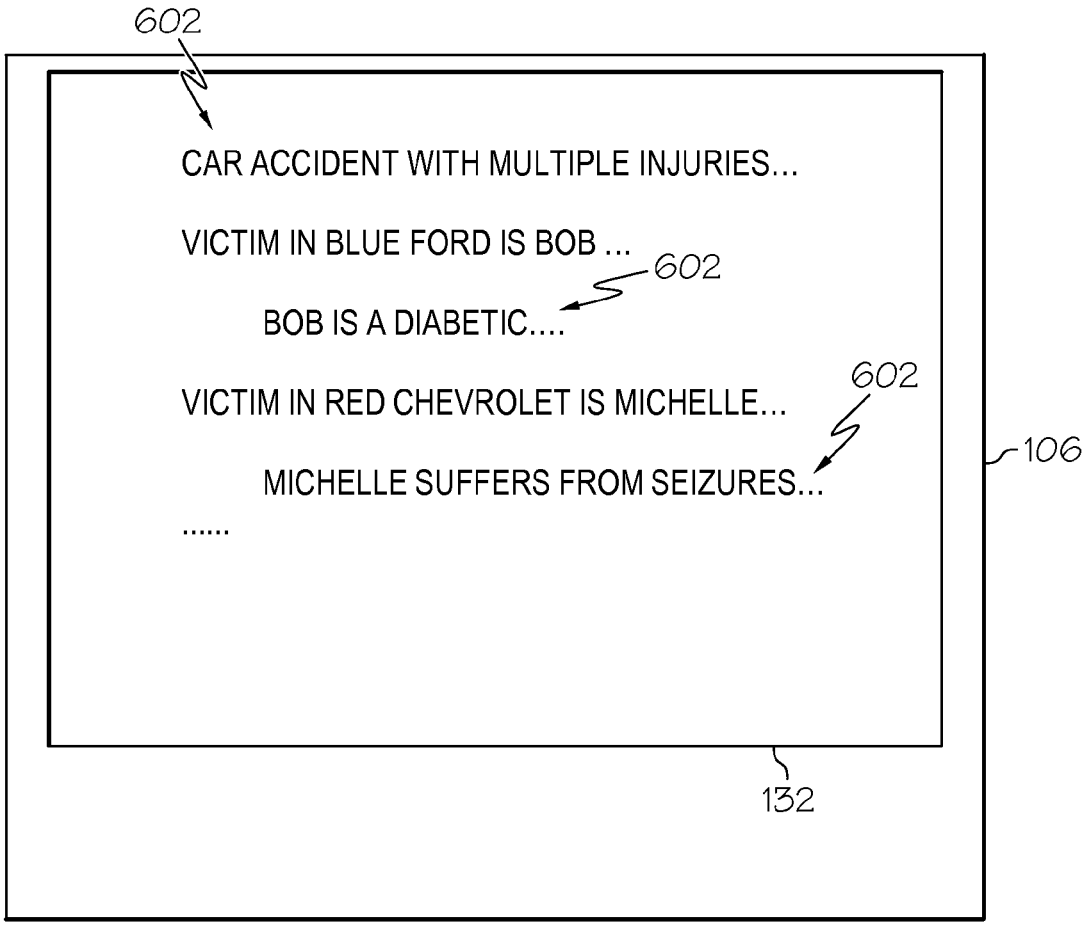

As noted above, the ERM 115 can send different information to each of the responders. For example, FIG. 6 shows that the message 502 sent by the ERM 115 has additional information 602 as compared to the information shown in FIG. 5. For example, the responder, e.g., RESPONDER_B, associated with the device 106 in FIG. 6 was sent medical history information 602 for each of the two victims in the car accident. As discussed above, the ERM 115 decided to send this additional information to this Responder_B since Responder_B is a doctor and knows how to best utilize this information for the well-being of victims. However, this information can be sent to anyone of the responders if the ERM 115 so chooses.

Figure 7:
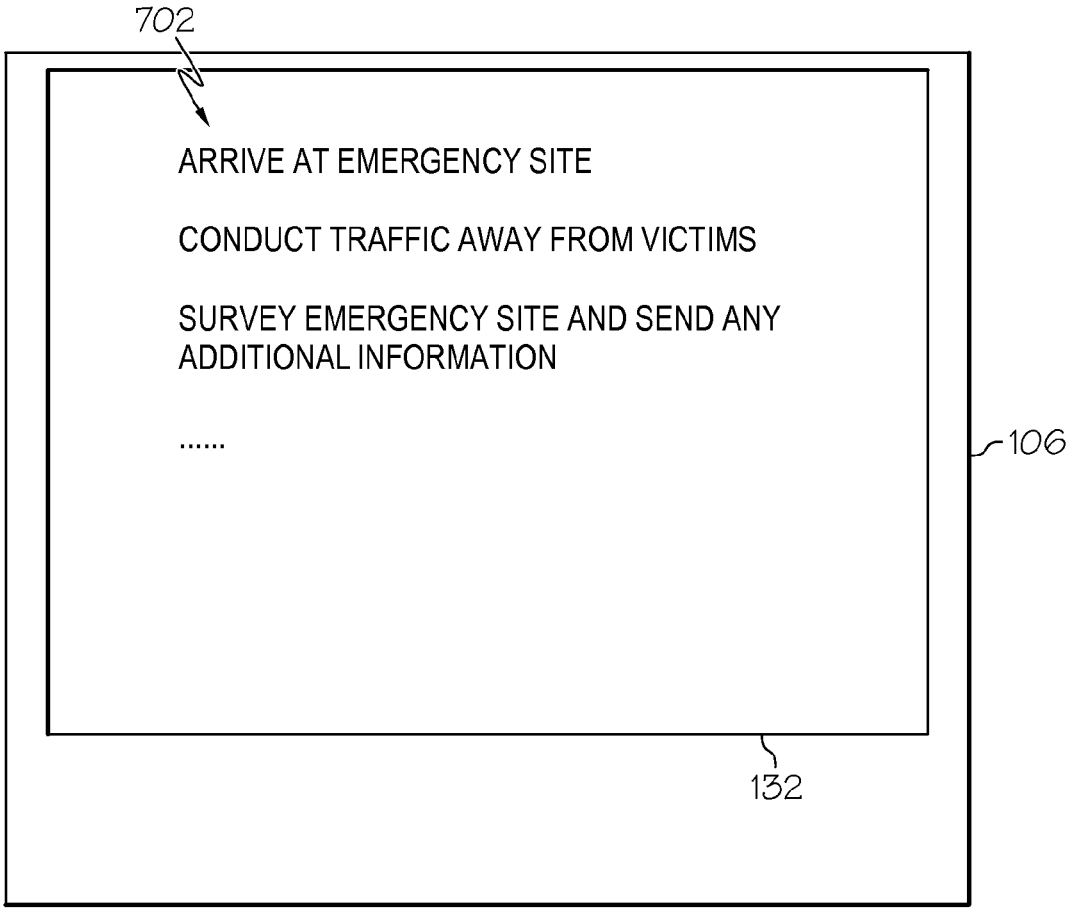
Figure 8:
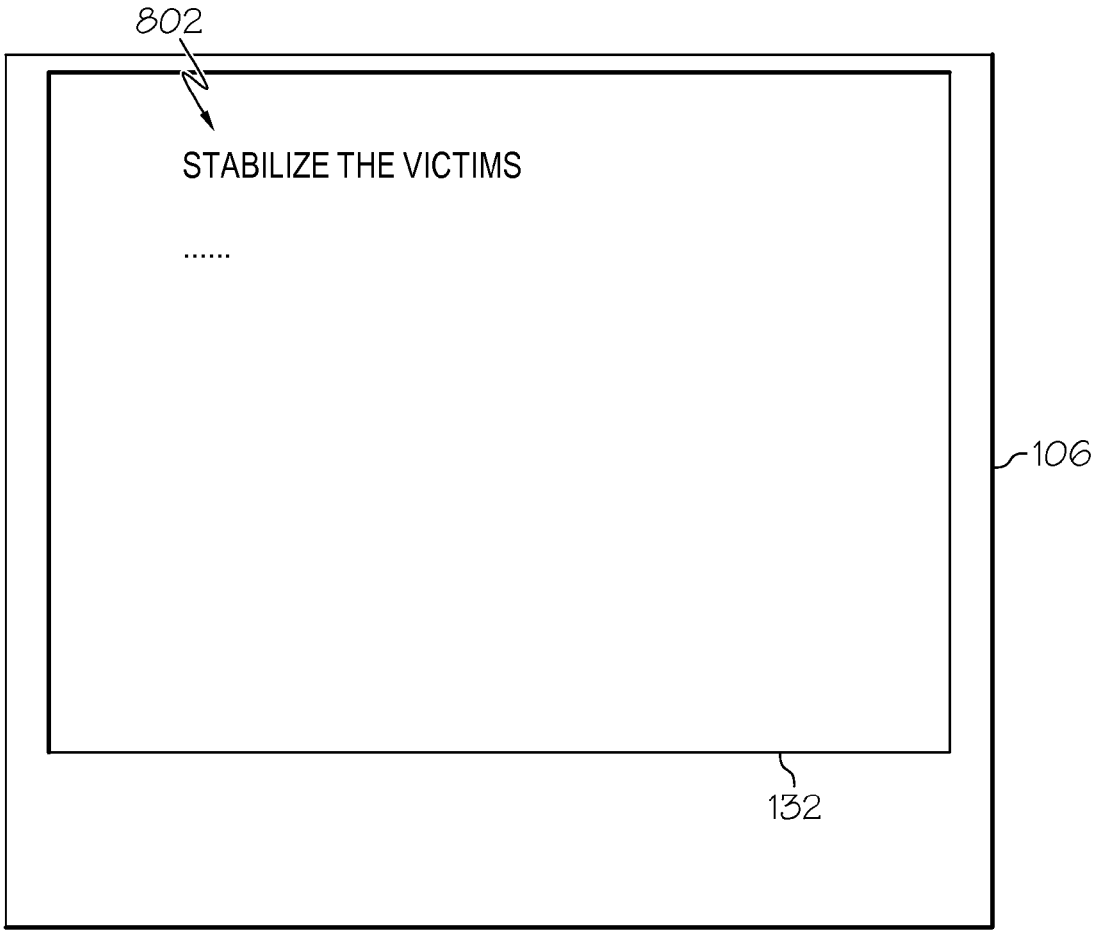

The ERM 115 also sends instructions on how to respond to the emergency to each of the responders, as shown in FIGS. 7 and 8. For example, FIG. 7 shows a device 106 associated with Responder_A. As discussed above, Responder_A does not have any special training. Therefore, the ERM 115 sends a set of instructions 702 to display on the ERS interface 132 that instructs Responder_A to perform tasks, such as directing traffic and obtaining additional information, that do not require specialized training (e.g., medical training). However, as can be seen in FIG. 8, the instructions 802 presented to Responder_B via the interface 132 are more specialized based on Responder_B's medical training. For example, the instructions 802 in FIG. 8 instruct Responder_B to stabilize the victims. It should be noted that the ERM 115 can also determine which response instructions to send to the responders based on the ETA of the official emergency responders to the site. For example, if the ERM 115 determines that the official responders will not be at the site until a given point in time which is above a given threshold or their ETA is increasing, more aggressive instructions can be sent to the civilian responders.

The ERM 115, in one embodiment, can dynamically update the information being sent to the responders based on data being received from the civilian responders and/or the official emergency responders. For example, a civilian responder that has been selected to respond to the emergency may be delayed in transit. Therefore, a responder currently at the emergency site may have his/her instructions updated to include one or more of the duties to be performed by the delayed responder. Also, official emergency responders may also be delayed. Therefore, the ERM 115 can update the information sent to the civilian responders based on information received from the official emergency responders.

Figure 9:
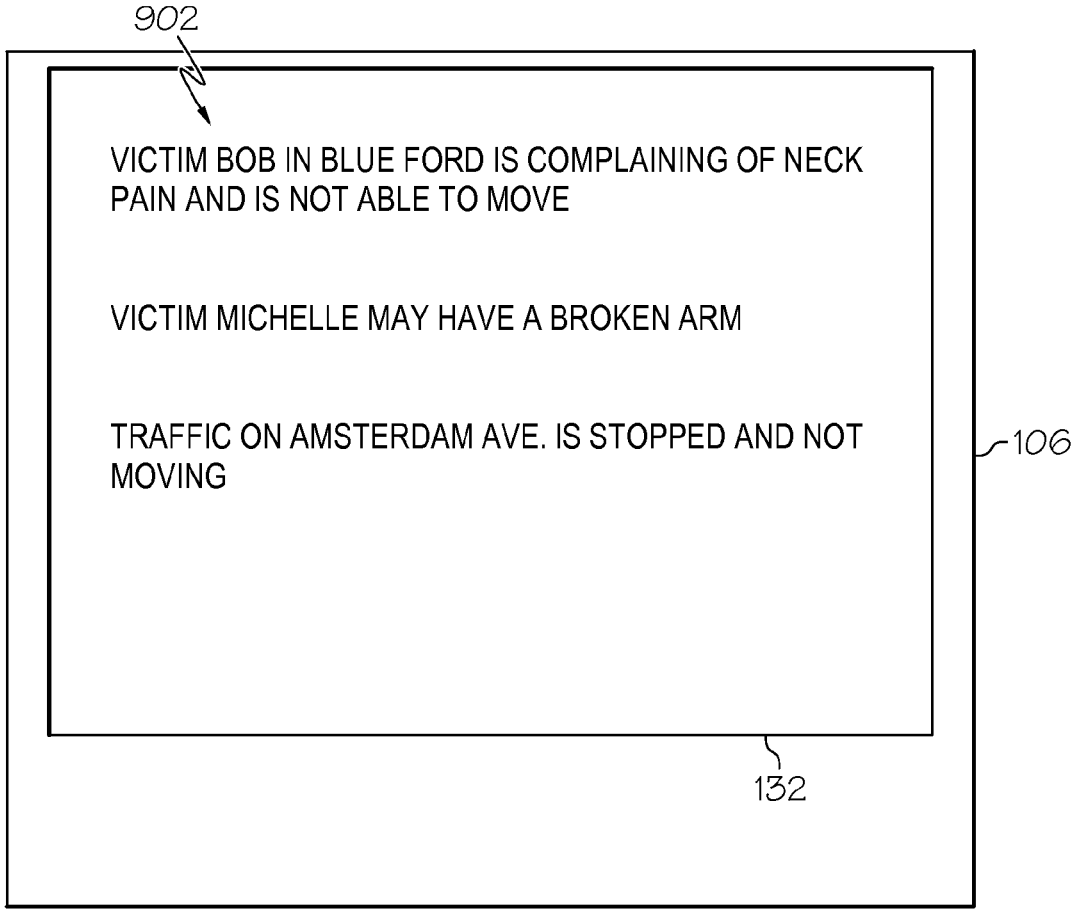

In addition, civilian responders currently that have arrived at the emergency site can send information regarding the current condition of the emergency site, the current condition of the victims, traffic conditions, or the like. This information can be relayed to other civilian responders and/or the official emergency responders. For example, FIG. 9 shows updated information 902 that the ERM 115 has sent to civilian responder devices 106 (and/or official emergency responder devices 108) based on information received from a civilian responder such as Responder_A. As can be seen from FIG. 9, the ERM 115 is now informing the responders that Bob is complaining of neck pain and is having trouble moving and Michelle may have a broken arm. With respect to traffic information received from a civilian responder at the site or received from environmental sensors discussed above, the ERM 115, via the traffic manager 126, can reroute traffic so that the official emergency responders can arrive at the emergency site as soon as possible.

Figure 11:
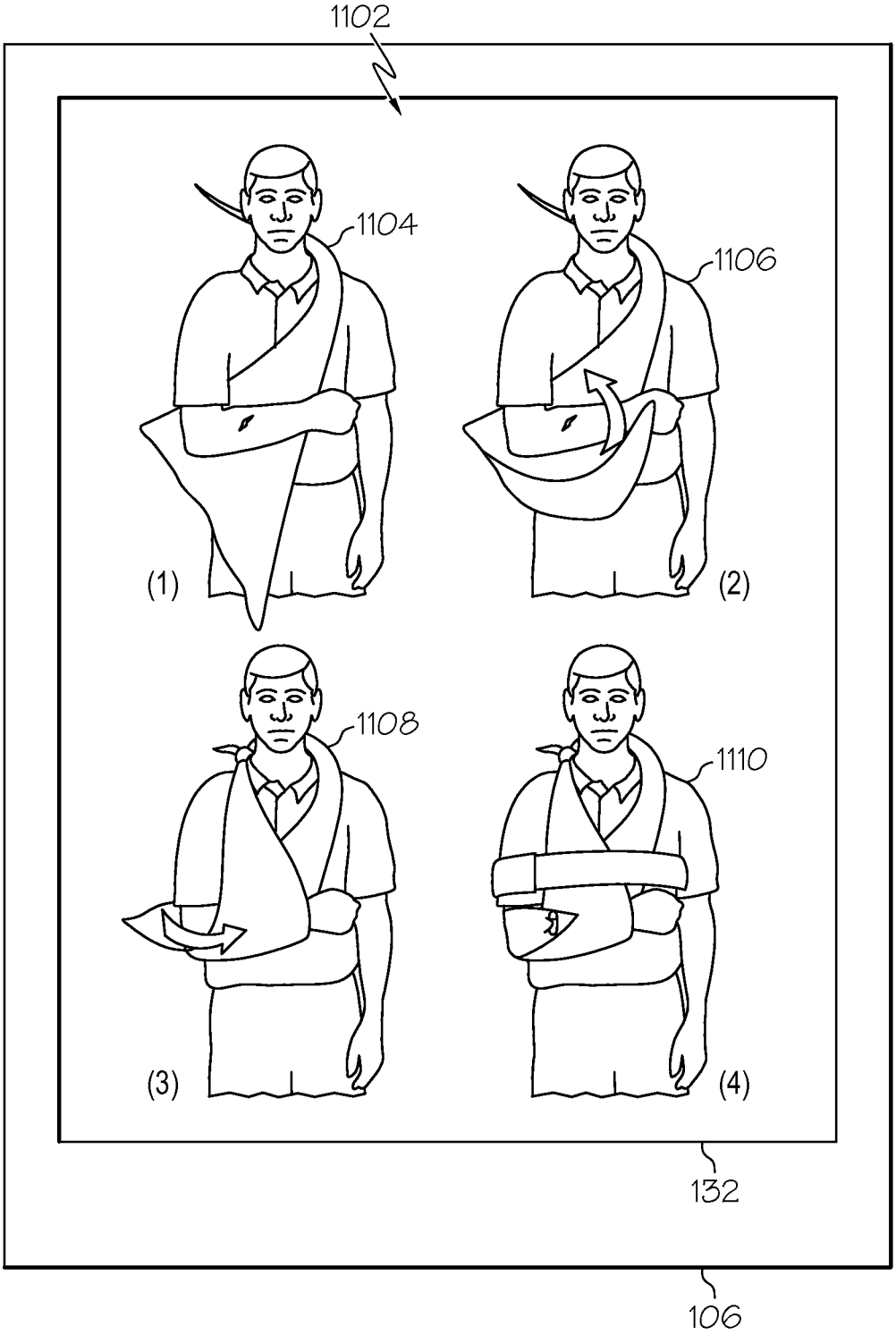

Based on this received information, the ERM 105 can also update the response instructions initially sent to the civilian responders. For example, FIG. 10 shows that the instructions 702 initially sent to Responder_A have been updated based on information received by one or more responders at the emergency site. For example, this updated set of instructions 1002 now instructs Responder_A to stabilize the victims if Responder_B has not arrived. In addition, the ERM 105 has provided instructions on how to treat the specific injuries of the victims. For example, these instructions 1002 instruct Responder_A how to stabilize Michelle's broken arm and Bob's injured neck. It should be noted that the information sent to and received from the ERM 105 can be continuously updated. The ERM 105 can also provide additional 1102 materials to help Responder_A perform these instructions. For Example, FIG. 11 shows that pictures 1104, 1106, 1108, 110 are presented to Responder_A via the interface 132 that correspond to each of the steps given to Responder_A for stabilizing Michelle's broken arm. It should be noted that this additional information can be presented to the responders in many formats such as, but not limited to, audio, video, text, web links, and/or the like.

The instructions 1002 and additional information 1102 associated with the instructions can be obtained by the ERM 115 from one or more servers 114 comprising this information or from information within the ERS server 102 itself. For example, based on a description of the victims received from a responder, the ERM 115 can analyze the emergency response related information 130 to identify how to properly respond to the given condition of the victims. The ERM 115 can then send this information to the responders at the scene, as discussed above. Also, the ERM 115 can relay the information received from the civilian responders to the devices 108 of the official emergency responders. The official emergency responders can then transmit the response instructions to the ERM 115, which relays these instructions to the appropriate civilian responders. Alternatively, the official emergency responders can send the response instructions directly to the civilian responders as well.

As will be appreciated by one skilled in the art, aspects of the present invention may be embodied as a system, method, or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Operational Flow Diagrams

Figure 12:
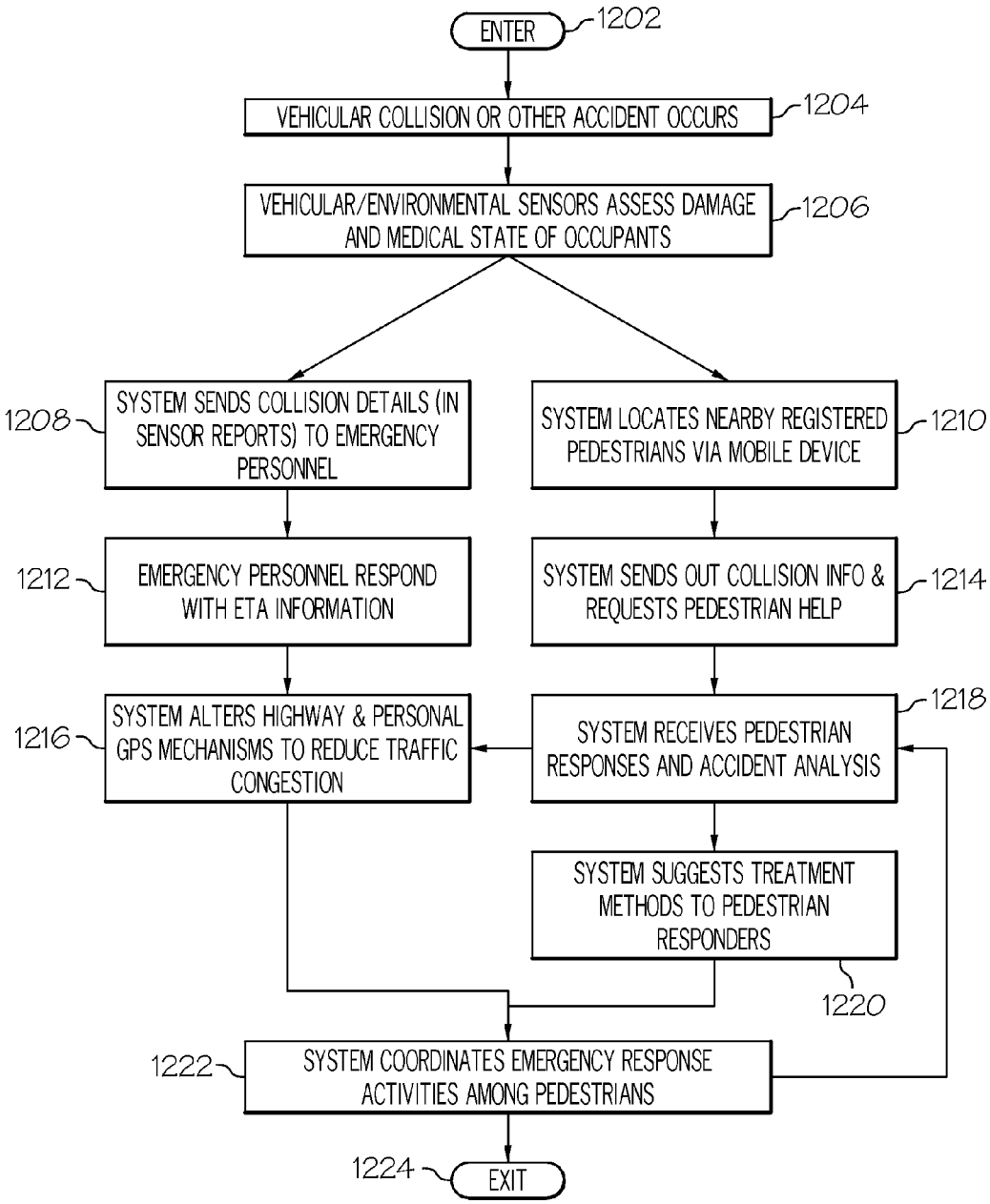
FIGS. 12-13 are operational flow diagrams illustrating various examples of managing civilian responders with respect to an emergency situation according to one embodiment of the present invention.
Figure 13:
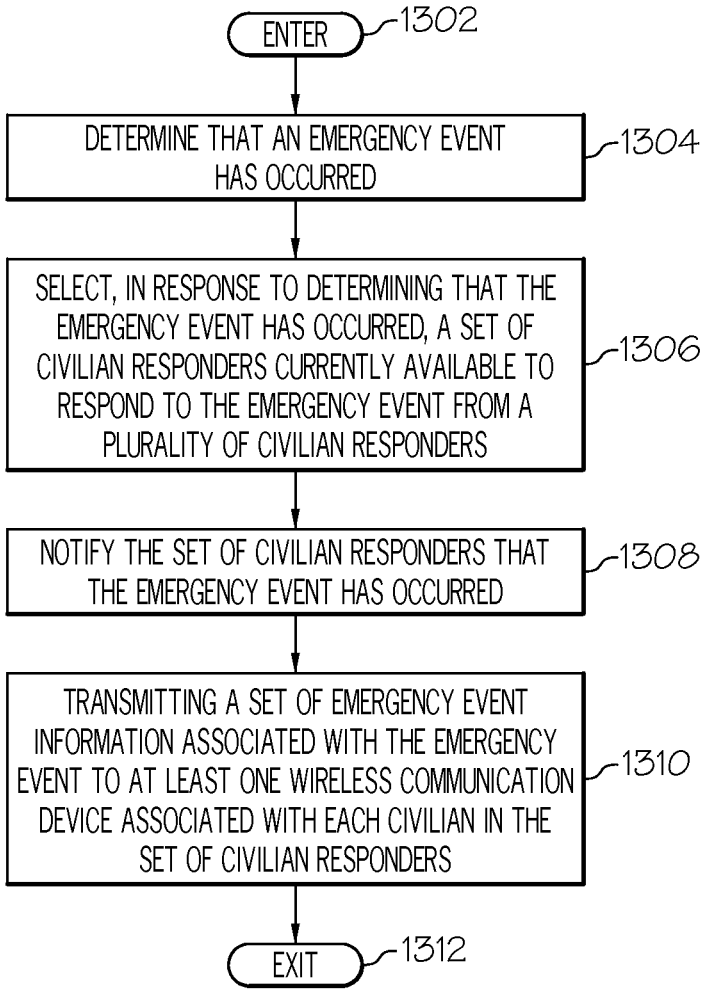

Referring now to FIGS. 12-13, the flowcharts and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

FIG. 12 is an operational flow diagram illustrating one example of managing civilian responders with respect to a detected emergency. The operational flow diagram of FIG. 12 begins at step 1202 and flows directly to step 1204. It should be noted that the steps shown in FIG. 12 are not required to be performed in any particular order and one or more steps (such as steps 1208 to 1220) can be performed in parallel. The ERM 115, at step 1204, detects that an emergency such as a vehicular collision or other accident has occurred, as discussed above. The ERM 115, at step 1206, queries or receives information from one or more vehicular/environmental sensors 140, 112 to assess damage and medical state of occupants.

The ERM 115, at step 1208, sends collision details to official emergency responders. The ERM 115, at step 1210, also locates nearby registered pedestrians via their wireless devices 106, as discussed above. The ERM 115, at step 1212, receives estimated time of arrival information from the official emergency responders. The ERM 115, at step 1214, sends out emergency description information and notification information to the identified pedestrians to determine who is willing/able to respond. The ERM 115, at step 1216, alters highway and personal GPS mechanisms to reduce traffic congestion so that responders can arrive at the emergency site as soon as possible. The ERM 115, at step 1218, selects a set of these pedestrians to respond to the emergency and also receives emergency related information from pedestrians at the emergency site. The ERM 115 can use this received information to further alter the traffic flow and/or GPS mechanisms. The ERM 115, at step 1220, provides response instructions to the pedestrians that have been selected. The ERM 115 can use the information received from pedestrians at the emergency site to determine which response instructions to send the pedestrians and/or update previously sent instructions. The ERM 115, at step 1222, coordinates emergency response activities among the selected pedestrians. The control flow then returns to step 1218 to perform a loop where information is received from pedestrians at the emergency cite so that information sent to other pedestrians and official emergency responders can be updated. Alternatively, the control flow can exit at step 1224.

FIG. 13 is an operational flow diagram illustrating another example of managing civilian responders with respect to a detected emergency. The operational flow diagram of FIG. 13 begins at step 1302 and flows directly to step 1304. It should be noted that the steps shown in FIG. 13 are not required to be performed in any particular order and one or more steps can be performed in parallel. The ERM 115, at step 1304, determines that an emergency event has occurred. The ERM 115, at step 1306, selects, in response to determining that the emergency event has occurred, a set of civilian responders currently available to respond to the emergency event from a plurality of civilian responders. Each civilian responder in the set of civilian responder is associated with at least one wireless communication device 106. The ERM 115, at step 1308, notifies the set of civilian responders that the emergency event has occurred. The ERM 115, at step 1310, transmits a set of emergency event information associated with the emergency event to at least one wireless communication device 106 associated with each civilian in the set of civilian responders. The control flow then exits at step 1312.

Information Processing System

Figure 14:
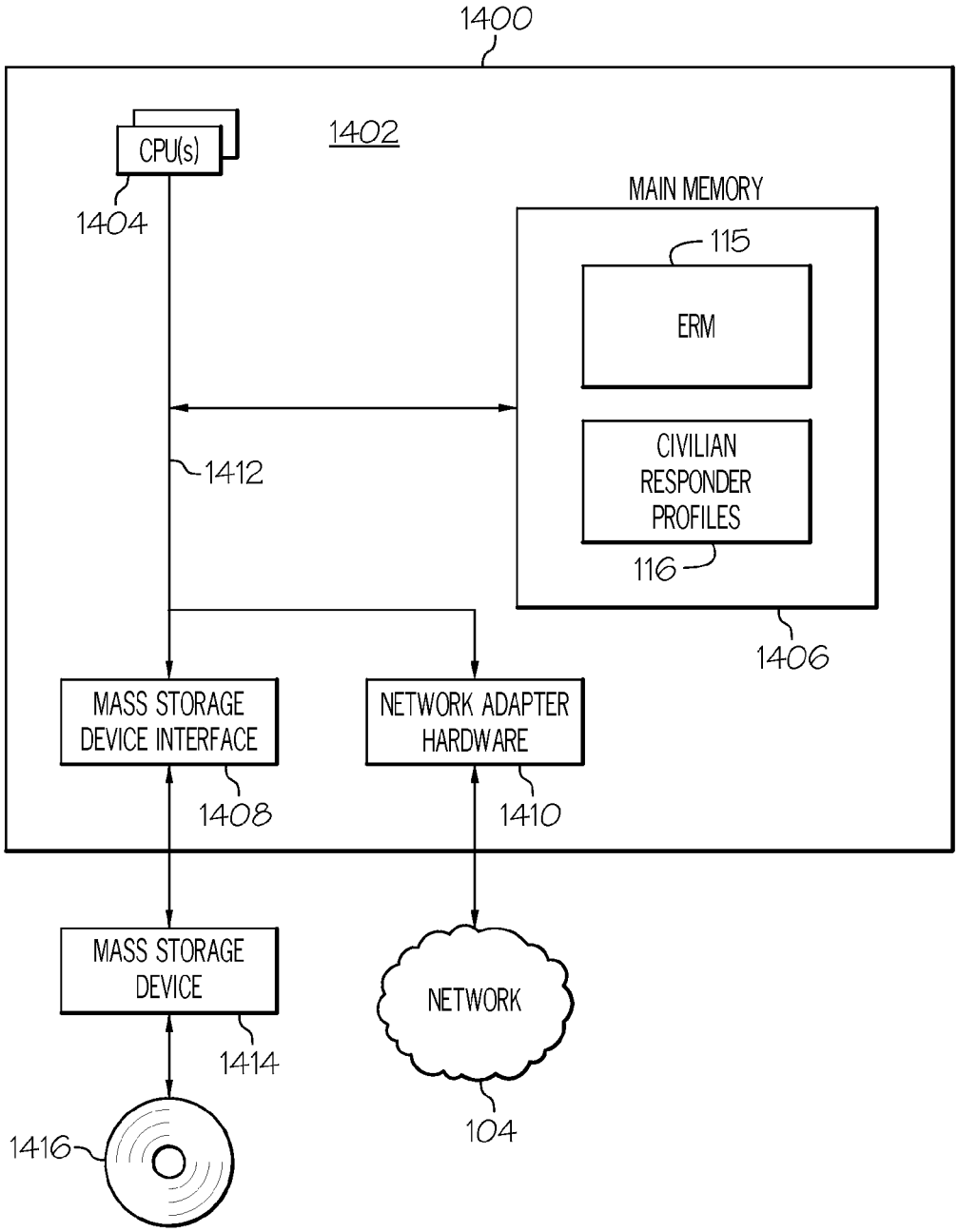
FIG. 14 is a block diagram illustrating a detailed view of an information processing system according to one embodiment of the present invention.

FIG. 14 is a block diagram illustrating a more detailed view of an information processing system 1400, such as the ERS system 102, that can be utilized in the operating environment 100 discussed above with respect to FIG. 1. The information processing system 1400 is based upon a suitably configured processing system adapted to implement one or more embodiments of the present invention. Similarly, any suitably configured processing system can be used as the information processing system 1400 by embodiments of the present invention.

The information processing system 1400 includes a computer 1402. The computer 1402 has a processor(s) 1404 that is connected to a main memory 1406, mass storage interface 1408, and network adapter hardware 1410. A system bus 1412 interconnects these system components. The main memory 1406, in one embodiment, comprises the ERM 115, its components, and civilian responder profiles 116 discussed above.

Although illustrated as concurrently resident in the main memory 1406, it is clear that respective components of the main memory 1406 are not required to be completely resident in the main memory 1406 at all times or even at the same time. In one embodiment, the information processing system 1400 utilizes conventional virtual addressing mechanisms to allow programs to behave as if they have access to a large, single storage entity, referred to herein as a computer system memory, instead of access to multiple, smaller storage entities such as the main memory 1406 and data storage device 1416. Note that the term "computer system memory" is used herein to generically refer to the entire virtual memory of the information processing system 1400.

The mass storage interface 1408 is used to connect mass storage devices, such as mass storage device 1414, to the information processing system 1400. One specific type of data storage device is an optical drive such as a CD/DVD drive, which may be used to store data to and read data from a computer readable medium or storage product such as (but not limited to) a CD/DVD 1416. Another type of data storage device is a data storage device configured to support, for example, NTFS type file system operations.

Although only one CPU 1404 is illustrated for computer 1402, computer systems with multiple CPUs can be used equally effectively. Embodiments of the present invention further incorporate interfaces that each includes separate, fully programmed microprocessors that are used to off-load processing from the CPU 1404. An operating system (not shown) included in the main memory is a suitable multitasking operating system such as any of the Linux, UNIX, Windows, and Windows Server based operating systems. Embodiments of the present invention are able to use any other suitable operating system. Some embodiments of the present invention utilize architectures, such as an object oriented framework mechanism, that allows instructions of the components of operating system (not shown) to be executed on any processor located within the information processing system 1400. The network adapter hardware 1410 is used to provide an interface to a network 104. Embodiments of the present invention are able to be adapted to work with any data communications connections including present day analog and/or digital techniques or via a future networking mechanism.

Although the exemplary embodiments of the present invention are described in the context of a fully functional computer system, those of ordinary skill in the art will appreciate that various embodiments are capable of being distributed as a program product via CD or DVD, e.g. CD 1416, CD ROM, or other form of recordable media, or via any type of electronic transmission mechanism.

Wireless Device

Figure 15:
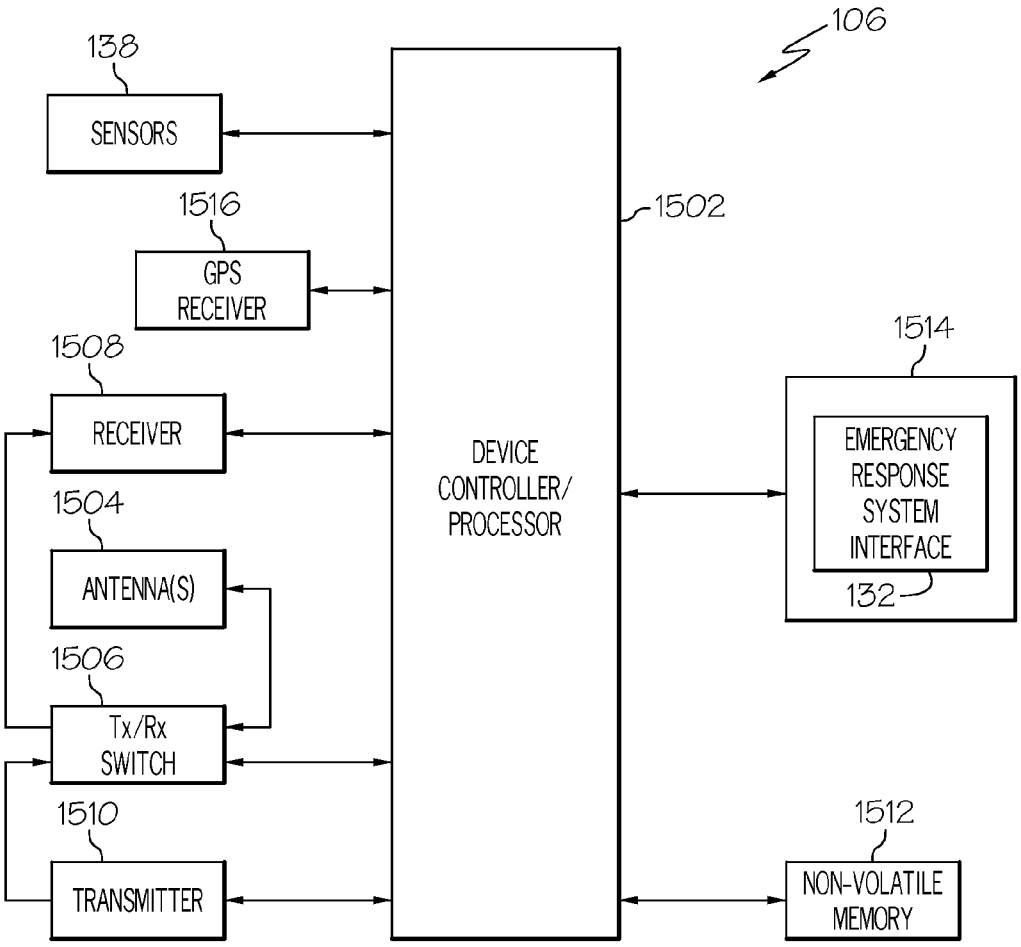
FIG. 15 is a block diagram illustrating a detailed view of a wireless device according to one embodiment of the present invention.

FIG. 15 is a block diagram showing a more detailed view of the responder device 106, 108 in FIG. 1. It is assumed that the reader is familiar with wireless communication devices. To simplify the present description, only that portion of a wireless communication device that is relevant to the present invention is discussed. The responder device 106 operates under the control of a device controller/processor 1502 that controls the sending and receiving of wireless communication signals. In receive mode, the device controller 1502 electrically couples at least one antenna 1504 through a transmit/receive switch 1506 to a receiver 1508. The receiver 1508 decodes the received signals and provides those decoded signals to the device controller 1502.

In transmit mode, the device controller 1502 electrically couples the at least one antenna 1504, through the transmit/receive switch 1506, to a transmitter 1510. The responder device 106 can also include an additional transceiver as discussed above. For example, a responder device 106 can communicate over multiple channels and accordingly would utilize multiple transceivers. However, the receiver 1508 and transmitter 1510 pair can also provide the functionality of the transceiver discussed above. The responder device 106 also includes volatile memory 1512 and non-volatile storage memory 1514. Either of these memories 1512, 1514 can comprise the emergency response interface 132 discussed above. One or more sensors 136, discussed above, are also communicatively coupled to the controller 1502. These components have been discussed above in greater detail. Lastly, as shown in FIG. 15, a GPS receiver module 1516 is used by the controller 1502 to determine a current location of the responder device 106 in the universal coordinate system. It should be noted that other location determination technologies (e.g., gyro based dead reckoning, accelerometer based determination, etc.) can be used in combination with, or as a substitute for, the GPS receiver 1516.

Non-Limiting Examples

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for managing emergency response services, the method comprising:

executing with at least one processor at an information processing system, the following:

determining that an emergency event has occurred;

selecting, in response to determining that the emergency event has occurred, a set of civilian responders currently available to respond to the emergency event from a plurality of civilian responders, each civilian responder in the set of civilian responder being associated with at least one wireless communication device;

notifying the set of civilian responders that the emergency event has occurred; and transmitting a set of emergency event information associated with the emergency event to at least one wireless communication device associated with each civilian in the set of civilian responders.

2. The method of claim 1, wherein determining that the emergency event has occurred comprises at least one of:

receiving a notification from a vehicle;

receiving a notification from an emergency response system; and receiving a notification from a wireless communication device associated with a civilian responder.

3. The method of claim 1, wherein selecting a set of civilian responders further comprises:

identifying a plurality of civilian responders within a given distance from the emergency event.

4. The method of claim 1, wherein selecting a set of civilian responders further comprises:

querying a plurality of civilian responders to determine if they are available to respond to the emergency event; and identifying one or more civilian responders within the plurality of civilian responders that have indicated that they are available.

5. The method of claim 1, wherein selecting a set of civilian responders is based on a set of attributes associated with each civilian responder in the set of civilian responders.

6. The method of claim 1, wherein the set of emergency event information comprises at least one of:

a description of the emergency event;

a location of the emergency event;

a set of medical information associated with one or more individuals involved in the emergency event;

a set of response instructions for responding to the emergency event; and a set of directions for arriving at the emergency event.

7. The method of claim 1, further comprising:

receiving a set of information from at least one of:

a set of environmental sensors;

a vehicle associated with the emergency event; and a set of individuals currently at the emergency event; and generating a description of the emergency event based on the set of information that has been received.

8. The method of claim 1, wherein transmitting the set of emergency event information further comprises:

sending a first set of emergency event information to a first civilian responder in the set of civilian responders; and sending at least a second set of emergency event information to at least a second civilian responder in the set of civilian responders, wherein the first set of information and the second set of information are different from each other.

9. The method of claim 1, further comprising:

receiving, in response to the transmitting, a set of information associated with the emergency event from at least one of the civilian responders in the set of civilian responders; and sending an updated set of emergency event information to the least one wireless communication device associated with each civilian in the set of civilian responders, the updated set of emergency event information being based on the set of information that has been received.

10. A system for managing emergency response services, the system comprising:

a memory;

a processor communicatively coupled to the memory; and an emergency response manager communicatively coupled to the memory and the processor, the emergency response manager being configured for performing a method comprising:

determining that an emergency event has occurred;

selecting, in response to determining that the emergency event has occurred, a set of civilian responders currently available to respond to the emergency event from a plurality of civilian responders, each civilian responder in the set of civilian responders being associated with at least one wireless communication device;

notifying the set of civilian responders that the emergency event has occurred; and transmitting a set of emergency event information associated with the emergency event to at least one wireless communication device associated with each civilian responder in the set of civilian responders.

11. The system of claim 10, wherein determining that the emergency event has occurred comprises at least one of:

receiving a notification from a vehicle;

receiving a notification from an emergency response system; and receiving a notification from a wireless communication device associated with a civilian responder.

12. The system of claim 11, wherein selecting a set of civilian responders further comprises:

identifying a plurality of civilian responders within a given distance from the emergency event.

13. The system of claim 12, wherein selecting a set of civilian responders further comprises:

querying a plurality of civilian responders to determine if they are available to respond to the emergency event; and identifying one or more civilian responders within the plurality of civilian responders that have indicated that they are available.

14. The system of claim 10, wherein transmitting the set of emergency event information further comprises:

sending a first set of emergency event information to a first civilian responder in the set of civilian responders; and sending at least a second set of emergency event information to at least a second civilian responder in the set of civilian responders, wherein the first set of information and the second set of information are different from each other.

15. A computer program product for managing emergency response services, the computer program product comprising:

a storage medium readable by a processing circuit and storing instructions for execution by the processing circuit for performing a method comprising:

determining that an emergency event has occurred;

selecting, in response to determining that the emergency event has occurred, a set of civilian responders currently available to respond to the emergency event from a plurality of civilian responders, each civilian responder in the set of civilian responders being associated with at least one wireless communication device;

notifying the set of civilian responders that the emergency event has occurred; and transmitting a set of emergency event information associated with the emergency event to at least one wireless communication device associated with each civilian in the set of civilian responders.

16. The computer program product of claim 15, wherein selecting a set of civilian responders further comprises:

identifying a plurality of civilian responders within a given distance from the emergency event.

17. The computer program product of claim 15, wherein selecting a set of civilian responders is based on a set of attributes associated with each civilian responder in the set of civilian responders.

18. The computer program product of claim 15, wherein the set of emergency event information comprises at least one of:

a description of the emergency event;

a location of the emergency event;

a set of medical information associated with one or more individuals involved in the emergency event;

a set of response instructions for responding to the emergency event; and a set of directions for arriving at the emergency event.

19. The computer program product of claim 15, wherein transmitting the set of emergency event information further comprises:

sending a first set of emergency event information to a first civilian responder in the set of civilian responders; and sending at least a second set of emergency event information to at least a second civilian responder in the set of civilian responders, wherein the first set of information and the second set of information are different from each other.

20. The computer program product of claim 15, the method further comprising:

receiving, in response to the transmitting, a set of information associated with the emergency event from at least one of the civilian responders in the set of civilian responders; and sending an updated set of emergency event information to the at least one wireless communication device associated with each civilian responder in the set of civilian responders, the updated set of emergency event information being based on the set of information that has been received.

* * * * *